United States Patent [19]

McGill et al.

[11] 4,399,199

[45] Aug. 16, 1983

[54] PROTECTIVE LAYER

[75] Inventors: Ian R. McGill, Thatcham; Gordon L. Selman, Sonning Common, England

[73] Assignee: Johnson, Matthey & Co., Limited, London, England

[21] Appl. No.: 308,788

[22] Filed: Oct. 5, 1981

Related U.S. Application Data

[63] Continuation of Ser. No. 115,553, Jan. 25, 1980, abandoned.

[30] Foreign Application Priority Data

Feb. 1, 1979 [GB] United Kingdom ..... 7903511

[51] Int. Cl.[3] ..... B32B 15/04

[52] U.S. Cl. ..... 428/633; 428/552; 428/564; 428/639; 428/670; 428/678

[58] Field of Search ..... 428/623, 628, 629, 632, 428/633, 639, 670, 678–681, 684, 685, 926, 552, 564; 148/31.5; 416/241 R, 241 B

[56] References Cited

U.S. PATENT DOCUMENTS

| | | | |
|---|---|---|---|
| 3,470,017 | 9/1969 | Rubin et al. | 428/670 |
| 3,486,833 | 12/1969 | Miller et al. | 416/241 |
| 3,719,519 | 3/1973 | Perugini | 428/633 |
| 3,819,338 | 6/1974 | Bungardt et al. | 428/926 |
| 3,837,894 | 9/1974 | Tucker, Jr. | 428/632 |
| 3,890,456 | 6/1975 | Dils | 428/670 |
| 3,961,910 | 6/1976 | Baladjanih et al. | 428/941 |
| 3,979,273 | 9/1976 | Panzera et al. | 428/670 |
| 3,999,956 | 12/1976 | Stueber et al. | 428/670 |
| 4,095,003 | 6/1978 | Weatherly et al. | 428/633 |
| 4,123,594 | 10/1978 | Chang | 428/670 |

*Primary Examiner*—Michael L. Lewis

*Attorney, Agent, or Firm*—Cushman, Darby & Cushman

[57] ABSTRACT

This invention relates to means for protecting substrates and in particular Ni- and Co-base superalloys from high temperatures, for example temperatures such as typically occur in gas turbine engines.

In more detail an article suitable for use all elevated temperature (up to 1600° C. and beyond) comprises a metallic substrate on which is deposited a first coating or layer comprising one or more of the platinum group metals or an alloy including one or more of the platinum group metals on which is deposited a second coating or layer comprising a thermal barrier layer.

6 Claims, No Drawings

PROTECTIVE LAYER

This is a continuation of application Ser. No. 115,553, filed Jan. 25, 1980, and now abandoned.

This invention relates to means for protecting substrates and in particular Ni- and Co-base superalloys from high temperatures, for example temperatures such as typically occur in gas turbine engines.

Improvements in the efficiency of gas turbine engines can in general best be achieved directly or indirectly by an increase in the temperature of the combustion gases incident on the turbine blades. The main constraint to the achievement of this objective is the limited choice of materials for the blades which will retain adequate strength and corrosion resistance above 1100° C. for sufficient lengths of time. New processing developments for advanced Ni- and Co-base superalloys have given the engine designer new limits of strength capability at the expense of environmental corrosion resistance. Simultaneous advances in coating technology have gone some way in achieving a satisfactory balance of materials requirements. However, further increases in gas temperature up to and even beyond 1600° C. are still required. To meet this problem refractory alloys and ceramics must be considered as potential materials for advanced engines or, alternatively, progress towards more sophisticated means of reducing metal temperature, for example by forced cooling, must be made.

Four methods of cooling to reduce metal surface temperature, namely convection, impingement, film and transpiration or effusion cooling, involve elaborate fabrication and machining techniques to produce complex geometry components. Although effective, they all involve an increase in the coolant to gas flow ratio which adversely affects the overall turbine efficiency. An alternative approach to surface cooling, and one which can be termed complementary to existing cooling techniques, is the concept of thermal barrier coating. This technique comprises effectively a transitional technology between a metallic and an all ceramic engine system, and some of the problems associated with ceramics operating in a high temperature, for example thermal cycling and erosion/corrosion-promoting environment, need to be carefully considered when designing such a coating formulation.

The principle of applying a low thermal conductivity ceramic to a metal substrate as a means of thermal insulation has been recognised for some time. Many of the problems which have arisen in the past have been associated with metal substrate/ceramic compatibility. Differences in thermal expansion between the alloy and oxide invariably cause spallation of the thermal barrier layer. Adhesion of the ceramic composition to the substrate has posed further problems. Many of these initial limitations have been overcome by applying to the substrate a first so-called bond coat, e.g. of Mo, Nichrome or NiCrAlY, followed by the preferred refractory oxide barrier layer, usually comprising some form of stabilised zirconia. Zirconia stabilised with either calcia, hafnia, magnesia or any of the rare earth oxides may be used as a barrier oxide due to its very low thermal conductivity, low density and high melting point. However, thermal expansion compatibility with normally used bond-coats is still far from adequate. This fact in general has lead to the development of the so-called graded thermal barrier system where compositional control of the coating from metal or metal/-ceramic to ceramic has met with some success. It is preferred, however, to limit the total barrier coating thickness to below 0.020 inches and develop a simple duplex metal-ceramic system.

Further to the mechanical problems of bonding ceramics to metals, the questions of chemical compatibility between the oxide and metal bond coat and the rate at which combustion gases can permeate the preferred oxide barrier must be taken into account. In the first case, nickel, nickel-aluminide or NiCrAlY bond coats are most suitable choices with respect to $ZrO_2$ as nickel oxide does not react in any way with monoclinic or cubic zirconia, although other MCrAlY compositions where M=Fe or Co may be poor second choice bond coat systems because of the significant reaction of cobalt oxide and iron oxide with zirconia. Although chemically inert towards zirconia, under oxidising conditions (normally experienced in gas turbines) nickel oxide NiO oxidises to $Ni_2O_3$ at 400° C. and reverts to NiO at approximately 600° C. The volume change which accompanies this reaction can exacerbate ceramic thermal barrier spallation.

We have now found that one or more of the platinum group metals, by which we mean platinum, palladium, rhodium, iridium, ruthenium and osmium, may be used as a layer intermediate the substrate and the refractory oxide barrier layer.

According to the present invention, therefore, an article suitable for use at elevated temperature, for example in a gas turbine engine, comprises a metallic substrate on which is deposited a first coating or layer comprising one or more of the platinum group metals or an alloy including one or more of the platinum group metals on which is deposited a second coating or layer comprising a thermal barrier layer.

Preferably: (i) the substrate material comprises an alloy, for example a Ni-, Co or Fe-based superalloy or a refractory alloy, or a refractory metal, (ii) the said first coating or layer comprises a protective coating composition typically formed from one or more of the platinum group metals and one or more refractory oxide forming elements such as Al, Zr, Ti and so on, (iii) the thickness of the thermal barrier layer is between 250 and 500 microns and (iv) the thermal barrier layer comprises a stabilized refractory oxide, for example zirconia stabilised with one or more of calcia, hafnia, magnesia, yttria or a rare earth oxide.

Alternatively, the said first coating or layer consists essentially of one or more of the platinum group metals or an alloy thereof having a thickness within the range 2–25 microns, preferably 3–10 microns.

Optionally, articles according to the present invention may further include one or more of the platinum group metals either in combination with the material of the thermal barrier layer and/or comprising a further layer (a so-called "overlayer") over the thermal barrier layer.

The platinum group metals which we prefer to use in articles according to the invention are platinum, rhodium and/or iridium. We have found that these metals are particularly efficacious due to their thermal expansion compatibility with stabilised zirconia and their low rates of oxygen permeation. Although the platinum group metals react with zirconia under extreme reducing conditions, the porous structure of and oxygen permeation through stabilised zirconia maintain a sufficient oxygen potential at the interface for no chemical interaction to occur.

Similarly, a platinum group metal used as an overlayer on thermal barrier systems provides a barrier to significant combustion gas penetration to the underlying substrate alloy. A further advantage of the overlayer system is the highly reflective nature of the platinum group metals. The high reflectance of the outer skin backed by a low thermal conductivity oxide layer provides a protective system capable of operating in environments where the combustion gas stream may be as high as 1600° C. A platinum group metal overlayer on a turbine blade would also increase the efficiency of the engine in that a very smooth surface would be presented to the combustion gases.

By way of example, a preferred total system may be prepared by (a) depositing on the preferred substrate between 5 and 12 micron of platinum by any of the standard techniques but preferably by fused salt plating, (b) diffusion bonding the said platinum layer to the substrate, for example at 700° C. for 1 hour in vacuo, and (c) plasma- or flame-spraying a stabilised zirconia coating to a depth of between 250 and 500 micron. A further annealing treatment may be given to stress relieve the total coating.

Alternatively, palladium may be used instead of platinum, at a film thickness between 10 and 25 microns, for example, or iridium may be used at a film thickness between say 2 and 7 microns.

A second preferred method would be to (a) apply the platinum group metal bond coat as above to the preferred substrate (b) zirconise and simultaneously diffusion bond the platinum layer to the substrate, e.g. zirconise using a vacuum pack cementation process operating with a pack composition of 90% zirconia, alumina or magnesia, 8% zirconium metal and 2% ammonium chloride activator at a temperature of 1050° C. for 1 hour, (c) pre-oxidise the platinum-zirconised coating for 1 hour at 800° C. and (d) apply the thermal barrier oxide by plasma- or flame-spraying. The latter technique produces an initial internally oxidised ($ZrO_2$) cermet type structure upon which is keyed the total stabilised zirconia barrier layer. The effective result is a graded thermal barrier system.

A third method is to apply the total thermal barrier composition by plasma- or flame-spraying sequentially platinum-zirconia powder compositions from at least 98% Pt 2% $ZrO_2$ at the substrate to 100% zirconia at the outer surface. In this instance, e.g. in flame-spraying, a controlled level of oxygen during processing with platinum- zirconium-stabilizer oxide powder mix can generate the desired graded insulation coating.

Of the many processing techniques available to those familiar with coatings application, the aim of the present invention is to improve the adherence, durability and corrosion resistance of a thermal barrier system without affecting the prime purpose of said system, namely to reduce substrate metal surface temperature thus allowing current high temperature materials to operate effectively in hotter combustion gas streams.

The system so described and the various methods of application involve the use of one or more of the platinum group metals or alloys as bond coats, integral metal/ceramic compositions or overlayers to generate effective high temperature insulation coatings.

Although this invention has been described with particular reference to components, for example turbine nozzle guide vanes, turbine blades, combustors and so on, of gas turbine engines, it may also find application in other technologies such as coal gasification, glass processing and oil refining.

Further, although specific reference has been made to the use of the present invention effectively to reduce metal wall temperatures using low thermal conductivity oxides, the methods herein described results in the production of effective erosion resistant coatings which have application not only in the field of gas turbine engines, but also in processing plant equipment where, for example, rapid pumping of abraisive slurries can cause premature failure of components.

We claim:

1. An article which is protected to retain strength and corrosion resistance when used in contact with hot gases at temperatures of up to 1600° C., said protected article including a metallic substrate on which there is directly deposited a first protective coating or layer having a thickness within the range of 2 to 25 microns thickness and consisting essentially of (1) one or more of the platinum group metals or (2) one or more of the platinum group metals and at least one refractory oxide forming element, protecting the surface of the metallic substrate and on which first coating or layer there is directly deposited a second coating or layer comprising a thermal barrier layer having a thickness between 250 and 500 microns, the thermal barrier layer being bonded to the metal substrate by means of said first coating or layer, the substrate being selected from the group consisting of nickel-, cobalt- and iron-based superalloys and the thermal barrier layer comprising stabilised zirconia, the first coating or layer being characterized by its thermal expansion compatibility with the stabilised zirconia and its low rate of oxygen permeation.

2. An article according to claim 1 wherein the refractory oxide forming element is selected from the group consisting of Al, Zr and Ti.

3. An article according to claim 1 wherein the stabilised zirconia is stabilised with at least one of the oxides calcia, hafnia, magnesia, yttria and the rare earth oxides.

4. An article according to claim 1 including an additional layer disposed over the thermal barrier layer, the additional layer comprising at least one platinum group metal.

5. An article according to claim 3 wherein the thermal barrier layer also contains one or more platinum group metals.

6. An article according to claim 1 wherein the platinum group metal is selected from the group consisting of platinum, rhodium and iridium.

* * * * *